US005899179A

United States Patent [19]

Sasaki et al.

[11] Patent Number: 5,899,179

[45] Date of Patent: May 4, 1999

[54] TWO-CYCLE INTERNAL COMBUSTION ENGINE

[75] Inventors: Katsunori Sasaki, Iwate; Katsuya Tajima, Tokyo, both of Japan

[73] Assignee: Kioritz Corporation, Tokyo, Japan

[21] Appl. No.: 08/986,076

[22] Filed: Dec. 5, 1997

[30] Foreign Application Priority Data

Dec. 6, 1996 [JP] Japan ..... 8-327087

[51] Int. Cl.[6] ..... F02M 29/04; B27B 17/00

[52] U.S. Cl. ..... 123/73 A

[58] Field of Search ..... 123/73 A, 73 R

[56] References Cited

U.S. PATENT DOCUMENTS 5,699,761 12/1997 Yamaguchi et al. ..... 123/73 A 5,727,506 3/1998 Tajima et al. ..... 123/73 A

*Primary Examiner*—Marguerite McMahon

*Attorney, Agent, or Firm*—Baker & Botts, L.L.P.

[57] ABSTRACT

A two-cycle internal combustion engine including a carburetor, a crankcase provided with a crank chamber and a suction port, an insulator attached to the crankcase and provided with a suction passage for introducing an air-fuel mixture from the carburetor to the suction port, and a reed valve whose proximal end portion is fixed to the insulator so as to allow a free end portion thereof to be optionally press-contacted with the downstream side end face of the insulator, thereby opening or closing the suction passage, wherein a rib is formed on a portion of the downstream side end face of the insulator which is in the vicinity of the free end portion of the reed valve in such a manner as to protrude into the suction port.

3 Claims, 3 Drawing Sheets

TWO-CYCLE INTERNAL COMBUSTION ENGINE

BACKGROUND OF THE INVENTION

1. Field of the Invention

The present invention relates to a two-cycle internal combustion engine suited for use in a portable working machine, such as a chain saw, which is adapted to be operated in various postures.

2. The Prior Art

As a power source for a portable working machine, such as a chain saw, which is adapted to be operated in various postures, an air-cooled two-cycle gasoline internal combustion engine of small type (hereinafter referred to as a two-cycle internal combustion engine or simply as an engine) is usually employed. Since the size of this two-cycle internal combustion engine is generally larger in the longitudinal direction (height) than in the lateral direction, the engine is generally arranged horizontally in a main case, as in the case of a small chain saw for instance.

In the case of the aforementioned two-cycle internal combustion engine which is adapted to be laid horizontally in the main case of a working machine such as a chain saw, and particularly in the case of the engine as shown in Japanese Utility Model Unexamined Publication S/56-140402 (corresponds to U.S. Pat. No. 4,370,809) wherein a suction port is formed at the bottom (a forward portion when viewed in a laid posture) of a crankcase and an air-fuel mixture from a carburetor is sucked from a suction port via a lead valve to the crankcase to be pre-compressed therein, the resultant pre-compressed air-fuel mixture being transferred through a scavenging passage to a combustion chamber, there has been frequently experienced a phenomenon of extraordinary fluctuation of rotational speed or sudden stalling of the engine, resulting in the stoppage of the engine when the forward portion of the working machine (chain saw) is directed upward or obliquely upward after the working machine is operated while directing the forward portion thereof downward or obliquely downward for a period of time.

The cause for this phenomenon has been studied by the present inventors and made clear as follows. Namely, an unatomized raw fuel (a liquid fuel) which has adhered at first on the inner peripheral wall of a crank chamber of the engine flows into the suction port and is accumulated therein throughout a period when the forward portion of the working machine is directed downward or obliquely downward, i.e. when the suction port which opens to the crankcase of the engine is directed downward or obliquely downward. However, when the forward portion of the working machine is directed upward or obliquely upward, this unatomized fuel that has been accumulated in the suction port is caused to flow into the scavenging passage through the inner peripheral wall of the crank chamber and then rush-flows into the combustion chamber from the scavenging passage, thereby supplying an excessively thickened air-fuel mixture to the combustion chamber for combustion. In other words, the cause for the phenomenon can be ascribed to an undesirable flow of unatomized raw fuel due to the change in posture of the engine. However, no practically effective means has been provided to date for eliminating this undesirable phenomenon.

When the engine is in a state of high load and high rotational speed, the quantity of fuel per unit time is relatively large so that even if the unatomized raw fuel is allowed to rush-flow into the combustion chamber as mentioned above, no serious inconvenience would be caused to occur though some degree of fluctuation in rotational speed may be caused to occur. However, when the engine is in a state of idling, the quantity of fuel per unit time is relatively little so that when the unatomized raw fuel is allowed to rush-flow into the combustion chamber, the air-fuel mixture becomes excessive in thickeness, thus giving rise to a serious problem, e.g. the stoppage of the engine.

In an attempt to solve this problem, the present inventors have proposed (See Japanese Patent Unexamined Publication H/9-151739) the installation of a flow control portion such as a linear projection, groove or recess at a portion of the inner peripheral wall of the crank chamber which is in the vicinity of the suction port for reducing the flow rate of the unatomized raw fuel.

One example of a two-cycle internal combustion engine provided with this flow control portion is illustrated in FIG. 4, which shows a cross-section of the main portion of the two-cycle internal combustion engine. This two-cycle internal combustion engine 100 comprises a carburetor 30 constituting means for forming an air-fuel mixture, a crankcase 20 provided with a crank chamber 22 and a suction port 25 opening to the crank chamber 22, an insulator 40 attached to the crankcase 20 and provided with a suction passage 42 for introducing the air-fuel mixture from the carburetor 30 to the suction port 25, and a reed valve 35 formed of a tab-shaped elastic piece whose proximal end portion 35*a* is fixed to the downstream side end face 40A of the insulator 40 facing the suction port 25 so as to allow a free end portion 35*b* of the tab-shaped elastic piece to be optionally press-contacted with the downstream side end face 40A of the insulator 40, thereby opening or closing the suction passage 42.

A pair of linear projections 23 (each functioning as a flow-controlling member for controlling flow speed of unatomized raw fuel), each being rectangular in cross-section and spaced apart from the other, are formed on the inner peripheral wall 22A of the crank chamber 22, traversing the whole width of the crank chamber 22, in close proximity to the suction port 25 and in parallel with a crank shaft rotatably supported in the crankcase 20.

According to the engine 100 constructed in this manner, even if the unatomized raw fuel which has been trapped at the suction port 25 tends to flow into the scavenging passage (the outside of the apparatus shown in FIG.4) through the inner peripheral surface 22A of the crank chamber 22, the flow of the unatomized raw fuel is interrupted by the pair of linear projections 23 (each functioning as a flow-controlling member) formed on the inner peripheral wall 22A of the crank chamber 22 in close proximity to the suction port 25, thus resulting in a prominent slow down in the flow rate of the unatomized raw fuel.

Therefore, the possibility that the unatomized raw fuel would flow into the combustion chamber in a rush-flow manner through the inner peripheral wall of the crank chamber can be remarkably reduced. As a result, the possibility of a violent fluctuation of rotational speed of the engine or a sudden stalling or stoppage of the engine can be remarkably reduced.

However, even in this engine 100 provided as mentioned above with a flow controlling member, i.e. the linear projections 23 formed on the inner peripheral surface 22A of the crank chamber 22, a phenomenon of rush-flow of unatomized raw fuel into the combustion chamber has been occasionally recognized when the suction port 25 is suddenly directed upward or obliquely upward after the suction port 25 has been directed downward or obliquely downward for a long period of time. Namely, a large quantity of the unatomized raw fuel tends to be trapped at the stepped corner portion P which is located at the downstream side end face 40A of the insulator 40 below the free end portion 35*b* of the reed valve 35, and the resultant trapped unatomized raw fuel is sometimes caused to rush-flow, passing over the linear projections 23, into the combustion chamber. In other words, the provision of the aforementioned flow-controlling member is not sufficient to completely control the flow of the unatomized raw fuel, i.e. the aforementioned problem is not yet completely solved.

BRIEF SUMMARY OF THE INVENTION

The present invention has been made under the circumstances mentioned above, and therefore an object of the present invention is to provide a two-cycle internal combustion engine which is capable of inhibiting the flow of unatomized raw fuel after the unatomized raw fuel is trapped at the suction port of the crankcase and, at the same time, which is capable of inhibiting the unatomized raw fuel from being trapped at the suction port of the crankcase, even if the posture of the engine is changed due to a change in posture of the working machine, thereby completely preventing the undesirable phenomenon of the stoppage of the engine due to a rush-flow of the unatomized raw fuel into the combustion chamber.

Namely, according to the present invention, there is provided a two-cycle internal combustion engine comprising an air-fuel mixture-generating means such as a carburetor, a crankcase provided with a crank chamber and a suction port which opens to the crank chamber, an insulator attached to the crankcase and provided with a suction passage for introducing the air-fuel mixture from the air-fuel mixture-generating means to the suction port, and a reed valve formed of a tab-shaped elastic piece whose proximal end portion is fixed to the downstream side end face of the insulator facing the suction port so as to allow a free end portion of the tab-shaped elastic piece to be optionally press-contacted with the downstream side end face of the insulator, thereby opening or closing the suction passage.

This two-cycle internal combustion engine is characterized in that a rib is formed at a portion of the downstream side end face of the insulator that is in the vicinity of the free end portion of the reed valve in such a manner as to protrude into the suction port.

According to a preferable embodiment of the present invention, the rib is located at a portion of the downstream side end face of the insulator which is set back from the brim of the suction passage by a region where the free end portion of the reed valve is press-contacted with the downstream side end face of the insulator.

According to a further preferable embodiment of the present invention, the rib is formed at a portion of the downstream side end face of the insulator in the form of an arc extending along the brim of the suction passage as well as along the free end portion of the reed valve.

In the two-cycle internal combustion engine constructed above according to the present invention, when the posture of the engine is suddenly altered, more specifically, when the suction port is suddenly directed upward or obliquely upward after the suction port has been kept directed downward or obliquely downward for a long period of time, the unatomized raw fuel accumulated at the stepped corner portion (which is formed between the suction port and a portion of the downstream side end face of the insulator which is located on a lower side of the free end portion of the reed valve) tends to flow into the inner peripheral wall of the crank chamber. However, a portion of the unatomized raw fuel is prevented from moving further into the inner peripheral wall of the crank chamber due to the presence of the rib formed at a portion of the downstream side end face of the insulator where the free end portion of the reed valve is located.

Moreover, since the rib is formed on a portion of the downstream side end face of the insulator where the free end portion of the reed valve is located, the air-fuel mixture flowing from the air-fuel mixture-generating means, such as a carburetor, into the suction port through the suction passage of the insulator when the reed valve is opened is caused to impinge against the rib. Thus, the flow of the air-fuel mixture is interrupted by the rib, i.e. the flow rate of the air-fuel mixture is altered as the air-fuel mixture passes over the rib, resulting in the generation of a turbulent flow near the rib or at the suction port where the unatomized raw fuel tends to be accumulated. As a result, the unatomized raw fuel would hardly be accumulated at the suction port and, at the same time, the unatomized raw fuel accumulated, if any, at the suction port would be changed into the air-fuel mixture, thus making it difficult for the liquid unatomized raw fuel to adhere to the inner peripheral wall of the crank chamber.

As a result, even if the posture of the engine is changed due to a change in posture of the working machine, the unatomized raw fuel accumulated, if any, at the suction port can be prevented from flowing into the inner peripheral wall of the crank chamber, and, at the same time, the accumulation of unatomized raw fuel at the suction port of the crankcase can be sucked. Accordingly, it is possible to prevent an extraordinary change in rotation of engine, or accidents such as the stalling or stoppage of the engine due to a rush-flow of the unatomized raw fuel into the combustion chamber.

Moreover, since the two-cycle internal combustion engine according to the present invention can be manufactured by simply forming a rib on the conventional insulator, any increase in manufacturing cost by this modification would be negligible.

DETAILED DESCRIPTION OF THE INVENTION

The present invention will be further explained with reference to the drawings depicting one embodiment of a two-cycle internal combustion engine according to the invention.

Figure 1:
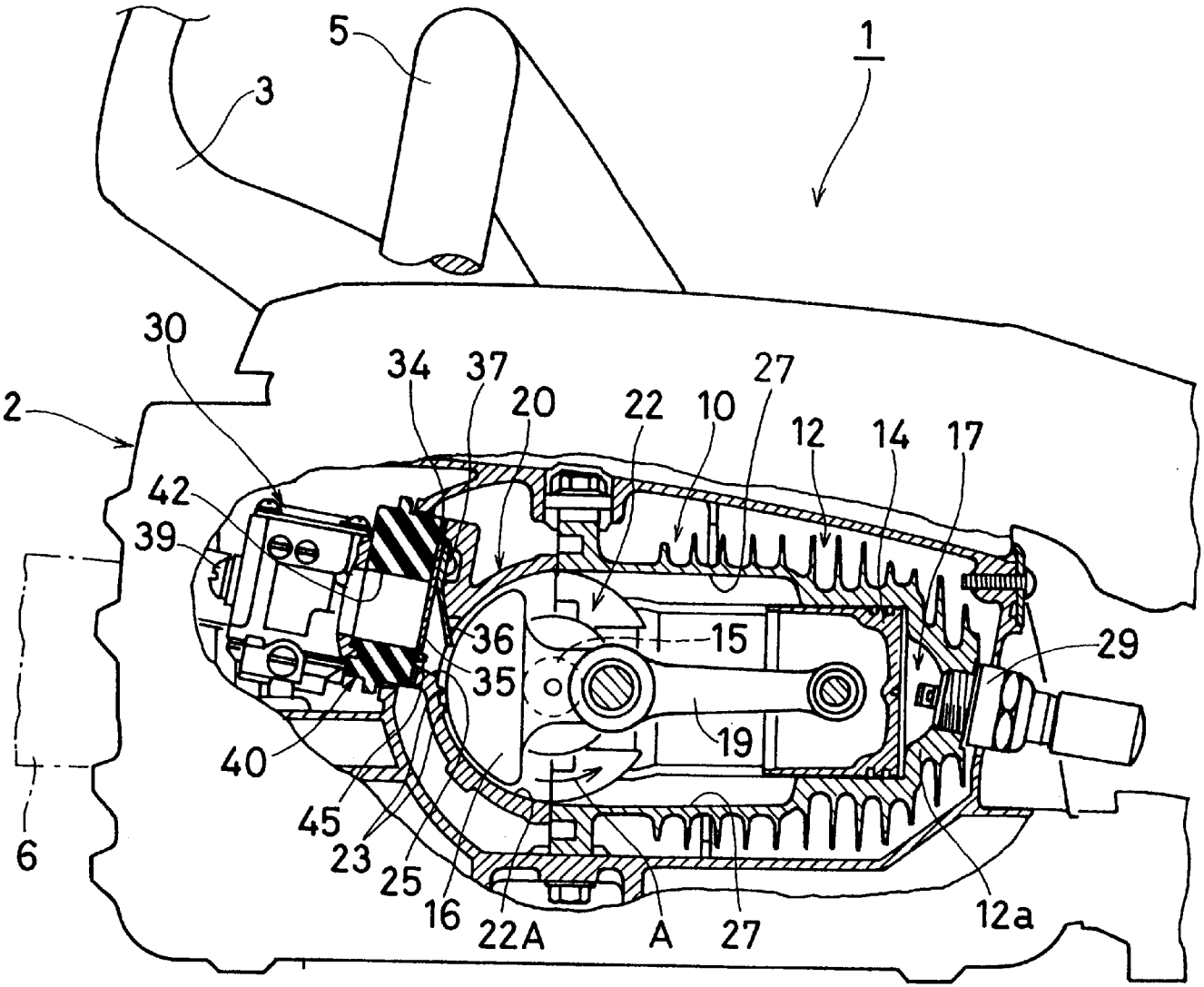
FIG. 1 is a longitudinal sectional view illustrating one embodiment of a two-cycle internal combustion engine according to the present invention.

FIG. 1 shows a chain saw 1 which is provided with a two-cycle internal combustion engine 10 according to the present invention.

The chain saw 1 illustrated herein comprises a main case 2, a working member 6 such as a saw chain which is detachably mounted on the forward portion of the main case 2, a brake handle 3 functioning also as a hand guard which is attached to the upper portion of the main case 2, and a main handle 5 which is also attached to the upper portion of the main case 2.

An air-cooled two-cycle gasoline engine 10 of small type according to this embodiment is housed in the main case 2 in such a manner that the engine 10 is substantially horizontally laid down with the cylinder head 12*a* thereof being directed rearward, i.e. a cylinder block 12 is disposed on the rear side, while a semi-circular crankcase 20 connected with the cylinder block 12 is disposed on the forward side, of the main case 2.

A piston 14 is inserted in the cylinder block 12, and a combustion chamber 17 is partitioned by the top face of the piston 14. An ignition plug 29 is attached to the top portion of the cylinder head 12*a*, the tip end portion of the plug 29 protruding into the combustion chamber 17.

The reciprocating movement of the piston 14 is converted via a connecting rod 19 into rotational movement of a crank shaft 15 which is axially supported by a bearing (not shown) disposed between the crankcase 20 and the lower portion of the cylinder block 12. When the crank shaft 15 is rotated in this manner, the balance weight 16 which is attached to the crank shaft 15 is caused to rotate within the crank chamber 22 defined between the crankcase 20 and the lower portion of the cylinder block 12 and in the direction indicated by the arrow A in FIG. 1.

A suction port 25 is formed at a portion of the crankcase 20 which is located on the upper side of the bottom of the crank chamber 22 (or the forward portion as viewed in the laid down state of the engine 10).

An air-fuel mixture supplied from a diaphragm type carburetor 30 functioning as an air-fuel mixture-generating means is transferred into a suction passage 42 formed in an insulator 40, which is attached with a sealing member 34 to the crankcase 20, and then introduced through a reed valve 35, which is made of a tab-like elastic piece, into the suction port 25. Then, the air-fuel mixture thus introduced into the suction port 25 is sucked and pre-compressed in the crank chamber 22 to be subsequently introduced, via the scavenging passages 27 communicating with the crank chamber 22, into the combustion chamber 17.

Figure 2:
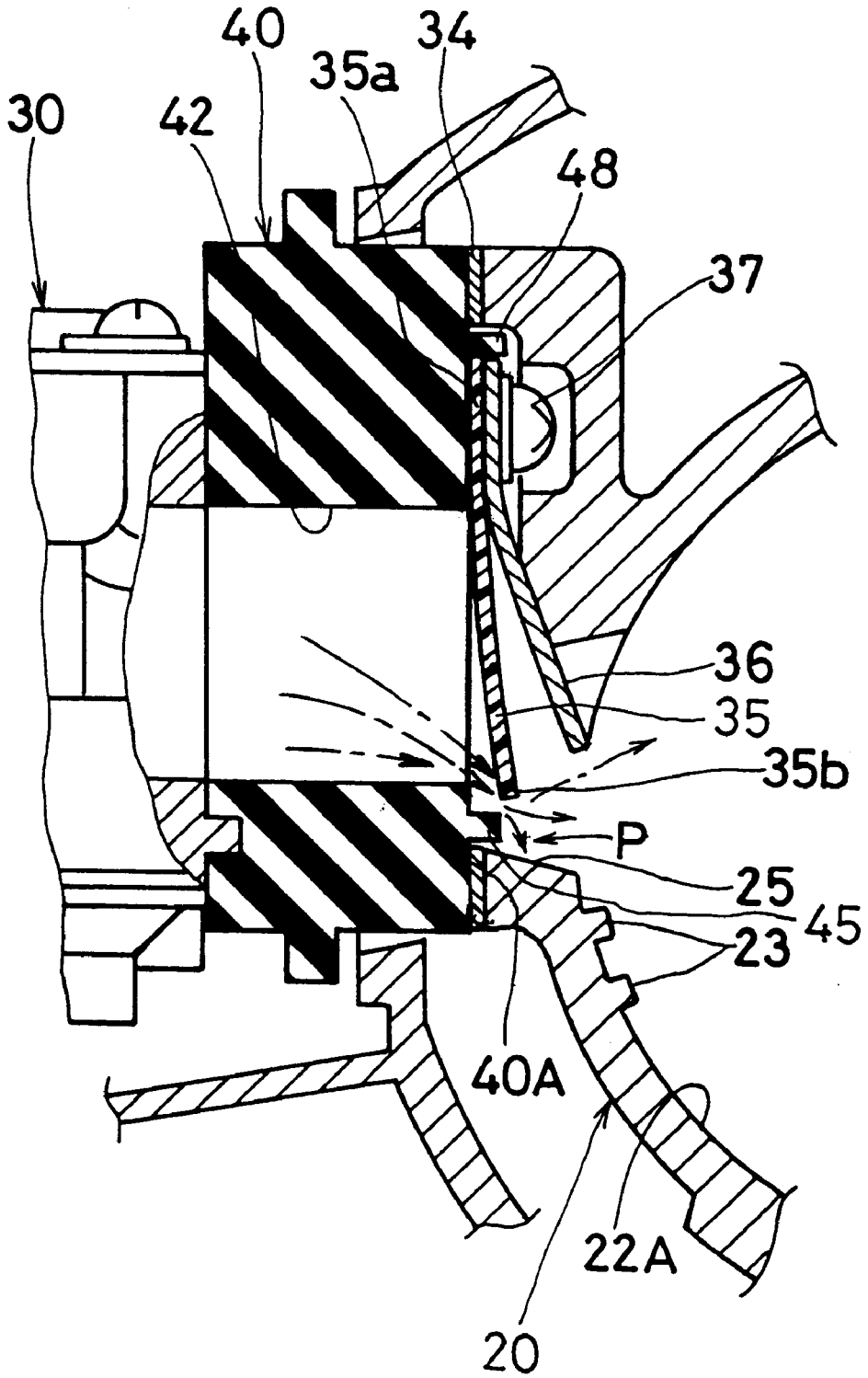
FIG. 2 is a partially sectioned enlarged side view of a chain saw illustrating the suction port portion of the two-cycle internal combustion engine shown in FIG. 1.
Figure 3:
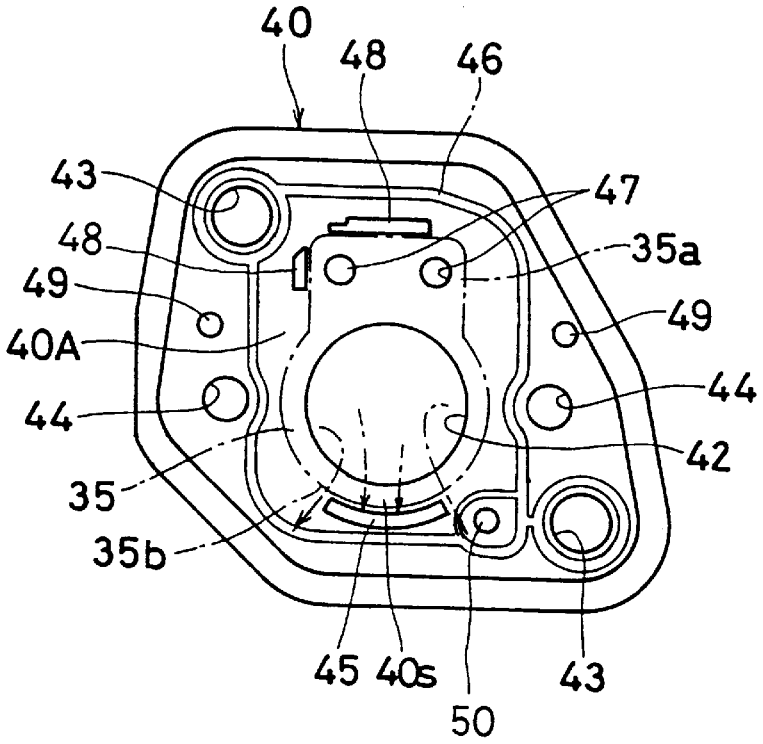
FIG. 3 is a plan view showing the downstream side end face of an insulator employed in the two-cycle internal combustion engine shown in FIG. 1.

As clearly seen from FIGS. 2 and 3, the reed valve 35 in this embodiment is secured together with a slightly bent reed stopper 36 to the downstream side end face (attachment surface) 40A of the insulator 40, which faces towards the suction port 25. More specifically, the proximal end portion 35*a* of the reed valve 35 is fastened together with the proximal end portion of the reed stopper 36 to the downstream side end face 40A of the insulator 40 by means of screws 37 so as to be optionally press-contacted with the downstream side end face 40A, thereby allowing the suction passage 42 to be opened or closed by the reed valve 35.

The insulator 40 (see FIG. 3) is provided with bolt-holes or tapped holes 43 and 44 for inserting attachment bolts and tapped holes 47 for inserting the reed valve-fastening screws 37, these holes being extended along the axial direction of the insulator 40. The insulator 40 is further provided at the downstream side end face 40A thereof with a circular rib 46 for hermetically sealing it with the crankcase 22. As shown in FIG. 3, the insulator 40 is further provided with columnar protrusions 49 for aligning it with the crankcase 22, with elongated protrusions 48 for positioning the reed valve 35 and with a pulsating pressure-drawing hole 50 communicating with the carburetor 30.

Additionally, a rib 45 is formed at a portion of downstream side end face 40A of the insulator 40 where the free end portion 35*b* of the reed valve 35 is located. More specifically, the rib 45 is located at a portion of the downstream side end face 40A which is set back from the brim of the suction passage 42 by a region 40*s* where the free end portion 35*b* of the reed valve is press-contacted with the downstream side end face 40A of the insulator 40. Further, the rib 45 is protruded into the suction port 25, partially encircling the free end portion 35*b* of the reed valve 35.

Namely, the rib 45 is formed on a portion of the downstream side end face 40A in the form of an arc extending along the brim of the air supply passage 42 as well as along the free end portion 35*b* of the reed valve 35.

Figure 4:
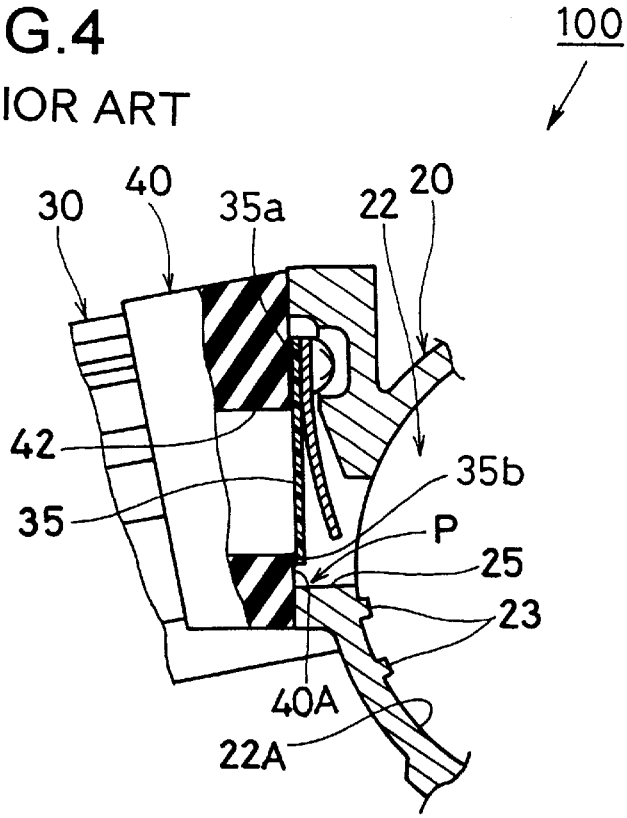
FIG.4 PRIOR ART
FIG. 4 is a partially sectioned enlarged side view of the suction port portion of a two-cycle internal combustion engine according to the prior art.

In the same manner as shown in FIG. 4, a pair of linear projections 23, each being rectangular in cross-section and spaced apart from the other, are formed on a portion of the inner peripheral wall 22A of the crank chamber 22 in close proximity to the suction port 25, traversing the whole width of the crank chamber 22 and in parallel with the crank shaft 15, the linear projections 23 functioning as flow-controlling members for reducing the flow rate of the unatomized raw fuel.

When the chain saw 1 constructed as described above is operated for a while with the forward portion thereof being directed downward or obliquely downward, the unatomized raw fuel which has adhered to the inner peripheral wall 22A of the crankcase 22 of the engine 10 flows slowly, passing over the linear protrusions 23, into the stepped corner portion P formed between a portion of the suction port 25 and the downstream side end face 40A of the insulator 40 located below the free end portion 35*b* of the reed valve 35, and is accumulated therein.

Subsequently, when the forward portion of the chain saw is directed upward or obliquely upward, a portion of this unatomized fuel accumulated at the stepped corner portion P tends to flow into the inner peripheral wall 22A of the crank chamber 22. However, this flow of the unatomized fuel is prevented from entering into the inner peripheral wall 22A of the crank chamber 22 due to the presence of the rib 45 protruded at the portion of the downstream side end face 40A of the insulator 40 which is located in close proximity to the free end portion 35*b* of the reed valve 35.

Furthermore, since the rib 45 is protruded at a portion of the downstream side end face 40A of the insulator 40 which is located close to the free end portion 35*b* of the reed valve 35, the air-fuel mixture flowing from the carburetor 30 into the suction port 25 through the suction passage 42 of the insulator 40 when the reed valve 35 is opened is caused to impinge against the rib 45 as indicated by the dashed lines in FIGS. 2 and 3. Thus, the flow of the air-fuel mixture is interrupted by the rib 45, i.e. the flow rate of the air-fuel mixture is altered as the air-fuel mixture passes by the rib 45, resulting in the generation of a turbulent flow near the rib 45 or at the stepped corner portion P of the suction port 25 where the unatomized raw fuel is accumulated. As a result, the unatomized raw fuel would be hardly accumulated at this suction port 25 and, at the same time, any unatomized raw fuel that might have accumulated at the suction port 25 would be changed into the air-fuel mixture, thus making it difficult for the liquid unatomized raw fuel to adhere onto the inner peripheral wall 22A of the crank chamber 22.

Additionally, even if any unatomized raw fuel which has been trapped at the suction inlet port 25 tends to flow into the lower scavenging passage 27 through the inner peripheral surface 22A of the crank chamber 22, the flow of the unatomized raw fuel is interrupted by the pair of linear projections 23 (each functioning as a flow-controlling member) formed on the inner peripheral wall 22A of the crank chamber 22 in close proximity to the suction port 25, thus resulting in a much reduced flow rate of the unatomized raw fuel. Therefore, it is possible according to the engine 10 of the present invention to minimize the possibility that any unatomized raw fuel accumulated at the stepped corner portion P of the suction port 25 would flow into the inner peripheral wall 22A of the crank chamber 22 even if the posture of the engine 10 is suddenly changed, due to a change in posture of the chain saw 1 for instance, and the possibility that the unatomized raw fuel would be accumulated at the stepped corner portion P of the suction port 25. As a result, the accident of a violent fluctuation of rotational speed of the engine 10 or a sudden stalling or stoppage of the engine 10 due to a rush-flow of unatomized raw fuel into the combustion chamber 17 can be effectively prevented.

Moreover, since the engine 10 according to this embodiment can be manufactured by simply forming a rib 45 on the conventional insulator 40, any increase in manufacturing cost resulting from this modification would be negligible.

In the foregoing explanation, the present invention has been explained with reference to one embodiment. However, the present invention should not be construed to be limited to this embodiment, but may be variously modified within the spirit and scope of the appended claims. For example, in the embodiment described above, the rib 45 is shaped in the form of an arc. However, the rib may take other configurations, such as being corrugated or zigzag in shape. Furthermore, more than one rib may be provided if desired.

As would be clearly understood from the foregoing explanations, since a rib is positioned at specific location on the downstream side end face of the insulator to be mounted on the crankcase according to the two-cycle internal combustion engine of the present invention, it is possible to minimize the possibilities that an accumulated unatomized raw fuel would flow into the inner peripheral wall of the crank chamber even if the posture of the engine is suddenly changed due to a change in posture of the working machine and that the unatomized raw fuel would be accumulated at the suction port of the crankcase. As a result, the accident of a violent fluctuation of rotational speed of the engine or a sudden stalling or stoppage of engine due to a rush-flow of the unatomized raw fuel into the combustion chamber can be effectively prevented.

We claim:

1. In a two-cycle internal combustion engine comprising an air-fuel mixture-generating means, a crankcase provided with a crank chamber and a suction port which opens to the crank chamber, an insulator attached to the crankcase and provided with a suction passage for introducing the air-fuel mixture from the air-fuel mixture-generating means to the suction port, and a reed valve formed of a tab-shaped elastic piece whose proximal end portion is fixed to the downstream side end face of the insulator facing the suction port so as to allow a free end portion of the tab-shaped elastic piece to be optionally press-contacted with the downstream side end face of the insulator, thereby opening or closing the suction passage, the improvement comprising:

a rib formed on a portion of the downstream side end face of the insulator which is in the vicinity of the free end portion of the reed valve in such a manner as to protrude into the suction port.

2. The two-cycle internal combustion engine according to claim 1, wherein said rib is located at a portion of the downstream side end face of the insulator which is set back from the brim of the suction passage by a region where the free end portion of the reed valve is press-contacted with the downstream side end face of the insulator.

3. The two-cycle internal combustion engine according to claim 1 or 2, wherein said rib is formed at a portion of the downstream side end face of the insulator in the form of arc extending along the brim of the suction passage as well as along the free end portion of the reed valve.

* * * * *

UNITED STATES PATENT AND TRADEMARK OFFICE

CERTIFICATE OF CORRECTION

PATENT NO. : 5,899,179
DATED : May 4, 1999
INVENTOR(S) : Sasaki, et al

It is certified that error appears in the above-identified patent and that said Letters Patent is hereby corrected as shown below:

On the title page. item [56] References Cited, U.S. PATENT DOCUMENTS: Insert -- 4,370,809 2/1983 Takahashi et al. --;

Column 8, line 35, "or 2" should be deleted.

Signed and Sealed this

Fifth Day of September, 2000

*Attest:*

*Attesting Officer*

Q. TODD DICKINSON

*Director of Patents and Trademarks*